United States Patent [19]

Johnson

[11] 4,118,901

[45] Oct. 10, 1978

[54] STRUCTURE FOR RELOCATABLE BUILDING WITH FOLDING PLATE ROOF AND FOLDING END WALLS

[76] Inventor: Delp W. Johnson, 240 Oakview Dr., San Carlos, Calif. 94070

[21] Appl. No.: 812,161

[22] Filed: Jul. 1, 1977

[51] Int. Cl.[2] ..... E04B 1/344

[52] U.S. Cl. ..... 52/18; 52/66; 52/69; 52/70

[58] Field of Search ..... 52/69, 70, 66, 71, 741, 52/745, 18

[56] References Cited

U.S. PATENT DOCUMENTS

| | | | |
|---|---|---|---|
| 2,835,931 | 5/1958 | Sterkin | 52/70 |
| 3,714,749 | 2/1973 | Aitken | 52/71 |
| 3,831,337 | 8/1974 | Johnson | 52/71 |
| 3,854,266 | 12/1974 | Salas | 52/71 |
| 4,024,680 | 5/1977 | Blyweert | 52/70 |

FOREIGN PATENT DOCUMENTS

| | | | |
|---|---|---|---|
| 458,642 | 1/1975 | U.S.S.R. | 52/71 |

*Primary Examiner*—Price C. Faw, Jr.
*Assistant Examiner*—Henry Raduazo

[57] ABSTRACT

A building having a roof constructed of a plurality of plates connected by hinges at the common edges, said plates initially arranged folded together, with lower edges of the outer plates hingeably connected to upper edge of side walls, and said side walls hingeably connected at each end of each side wall to a pair of end walls constructed of a plurality of wall panels, said wall panels hingeably interconnected along common vertical edges, and initially arranged folded together. Total projected width of end panels is substantially less than total width of roof plates. Unfolding the roof plates causes the side walls of the structure to move apart and the end walls to simultaneously unfold until the end walls are fully distended, at which position said end walls stop the roof plates from unfolding further, and retain the roof plates in a folded plate configuration.

Disclosure is made of a floor constructed of a plurality of hingeably connected floor panels arranged initially in a folded position, with each outer panel attached to a side wall. When the side walls move apart, said floor panels unfold to form a flat floor. The said floor may be incorporated in the described building.

3 Claims, 4 Drawing Figures

STRUCTURE FOR RELOCATABLE BUILDING WITH FOLDING PLATE ROOF AND FOLDING END WALLS

BACKGROUND OF THE INVENTION

A great need exists for one story buildings providing large open areas clear of columns with spans of 60 feet or more, especially schools, professional buildings, shopping centers and the like. There is a further need for such buildings to be relocatable so that they may be transported from one site to another in accordance with changing needs. It is desired that such buildings be safe, economical to construct, minimize site labor, and provide an aesthetically pleasing space. It is known that a folded plate is one of the most efficient structures, but difficult to construct and erect.

It is an object of this invention to provide a novel method to construct relocatable buildings incorporating the advantages of the folding plate roof with a foldable end wall that maintains a structural integrity for the building during all stages of the erection.

There are no known structures that provide the features of the disclosed building.

SUMMARY OF THE INVENTION

The present invention provides a building which can be prefabricated in a folded position of various materials, including plywood, stress skin, metal, concrete and plastics. Initially, the panels used to form wall panels and roof plates are arranged in parallel layers, with hinges between edges of adjacent roof plates, between outer roof plates and upper edges of side walls, between end edges of sidewalls and edges of outer panels of the end walls, and between adjacent wall panels.

The building is erected by lifting the assembly with the roof plates above the walls and the faces of the plates and panels in a vertical position, and securing the bottom of one side wall to the foundation, then unfolding the roof plates and the end walls simultaneously, causing the second side wall to move laterally until the end walls are fully distended and the roof plates are partially unfolded and restrained by the end walls for further unfolding, and the second side wall fully supports the unfolded outer edge of the folded roof plates.

The angle between side walls and unfolded end walls may be any desired angle, as shown in FIG. 2. The basic requirement of each design is that the panel of the end walls, when distended, restrain the roof plates in a partially unfolded configuration, and thus form a folded plate roof.

The sequence of erection may alternately be achieved in two stages: First, to unfold the end wall panels to their designed location, and; Second, to unfold the roof plates over the erected walls. This requires separating the outer roof plates from the side walls initially, and then making a field connection after the unfolding has been completed. The wall assembly may be first erected and the roof assembly subsequently lifted into position, unfolded and secured. This latter method of erection may be desirable when it is required to reduce the size of the folded assembly for shipping to the construction site.

It will be noted that under preferred method, all of the structural interconnections for the entire assembly are made in the folded position before lifting, and consequently the integrity of the entire structure is always secure; and further, that the hinged connections serve to cause the individual plates and panels to simultaneously come to the desired positions, and to maintain the roof plates at the desired angles to function as a folded plate roof.

It is further apparent that the sequence of erection can be reversed to fold the building into a package to facilitate relocation of the structure. It is further apparent that the interior wall finishes and the ceiling finishes are folded against one another within the structure and not exposed to damage from dust, dirt or weather, when the assembly is folded for shipping. It is further noted that various sizes and shapes of panels may be easily assembled by this method of construction and such assemblies will produce exotic structures when unfolded.

It is noted that in the preferred method during the unfolding operation, the pins of the upper hinges connecting pairs of end wall panels are pivotally secured at the valley points of corresponding intermediate roof plates. This connection synchronizes the unfolding process.

DESCRIPTION OF THE PREFERRED EMBODIMENTS

Figure 2:
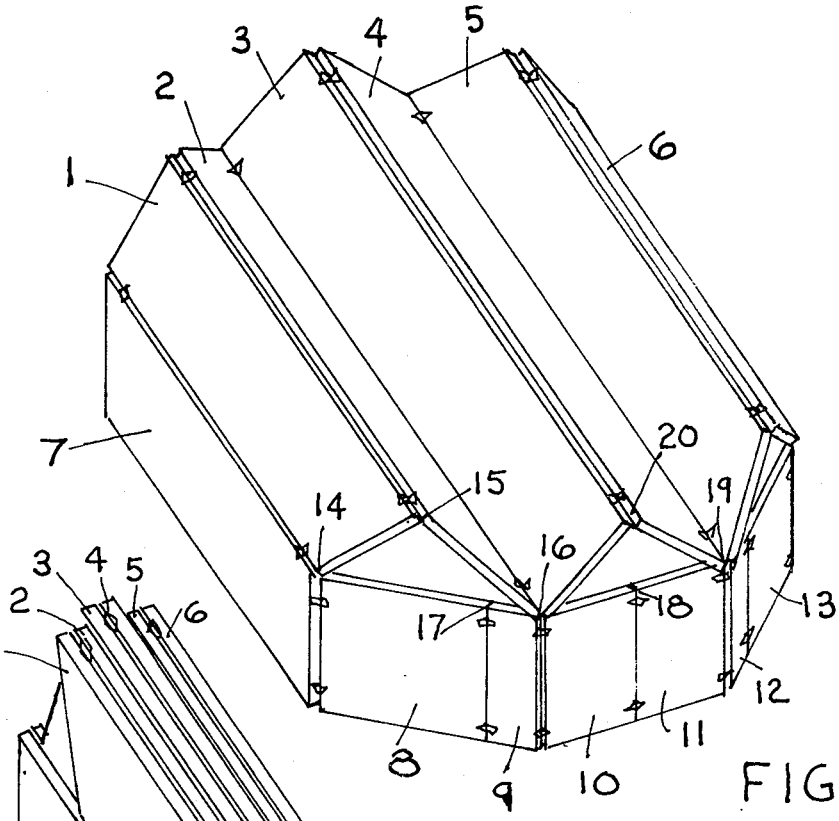
FIG. 2 Isometric projection of assembly unfolded.

Refer to FIGS. 1, 2, 3 and 4:

Roof plates 1, 2, 3, 4, 5 and 6 are hingeably connected along alternate upper and lower edges. Outer plates 1 and 6 are hingeably connected to side walls 7 (opposite side wall not shown). Side walls 7 are hingeably connected to end wall panels 8, which is hingeably connected along vertical edge to panel 9, 9 to 10, 10 to 11, 11 to 12, 12 to 13, and 13 to side wall counterpart of side wall 7 (not visible on Figure). Hinge pin of the upper hinge joining panels 9 and 10 is pivotally connected to point 16, and the pin of upper hinge joining panels 11 and 12 is pivotally connected to point 19.

Figure 1:
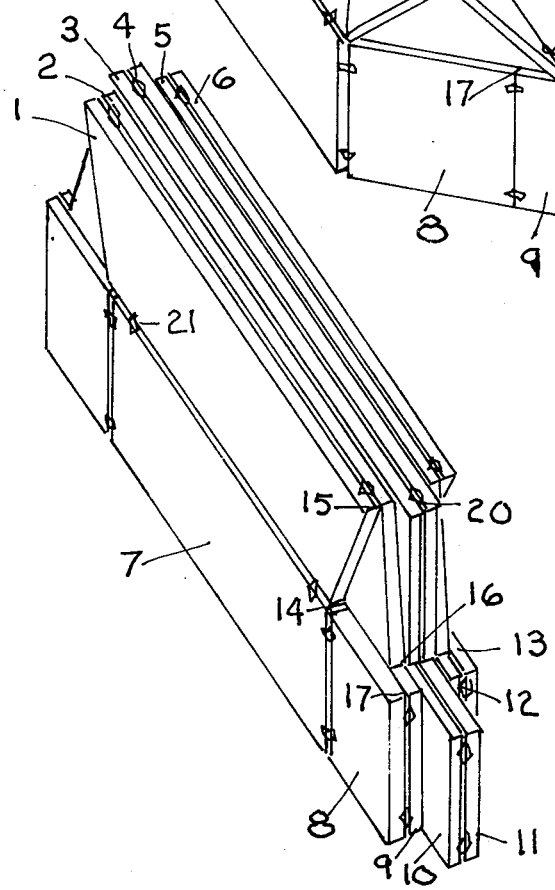
FIG. 1 Isometric projection of assembly ready for unfolding.

When the assembly is unfolded from its assembled configuration shown in FIG. 1 to unfolded configuration in FIG. 2, the end wall panels 8 and 9 form a cord line 17 to restrain points 14 and 16 from further unfolding, and secure plates 1 and 2 in a folded configuration. Panels 10 and 11 form a cord line 18 to restrain points 16 and 19 from further unfolding in order to restrain plates 3 and 4 in a folded configuration. Thus plates 1, 2, 3 and 4 form sections of a folded plate roof.

As many additional pairs of end wall panels and roof plates as desired may be added to extend the building to its desired width.

Figure 3:
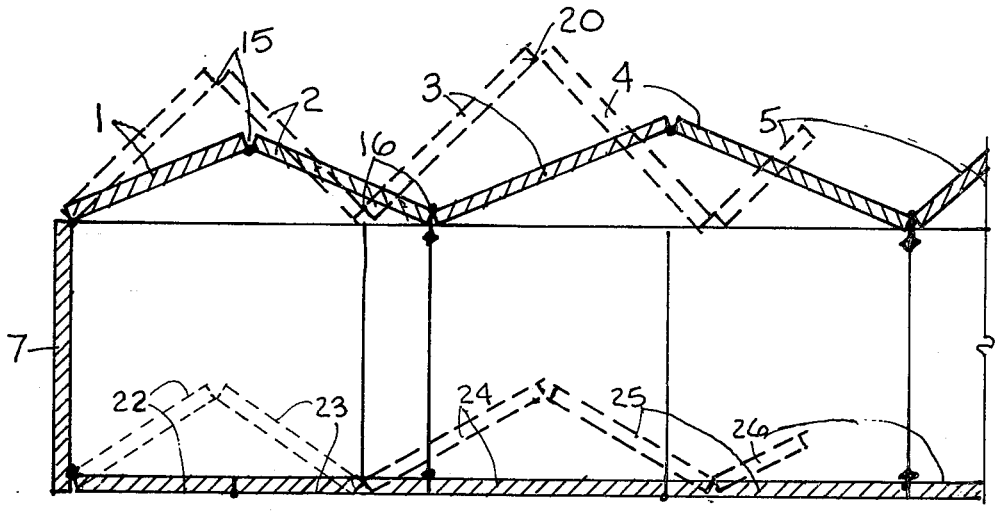
FIG. 3 Partial end section of FIG. 2 with folding floor shown.
Figure 4:
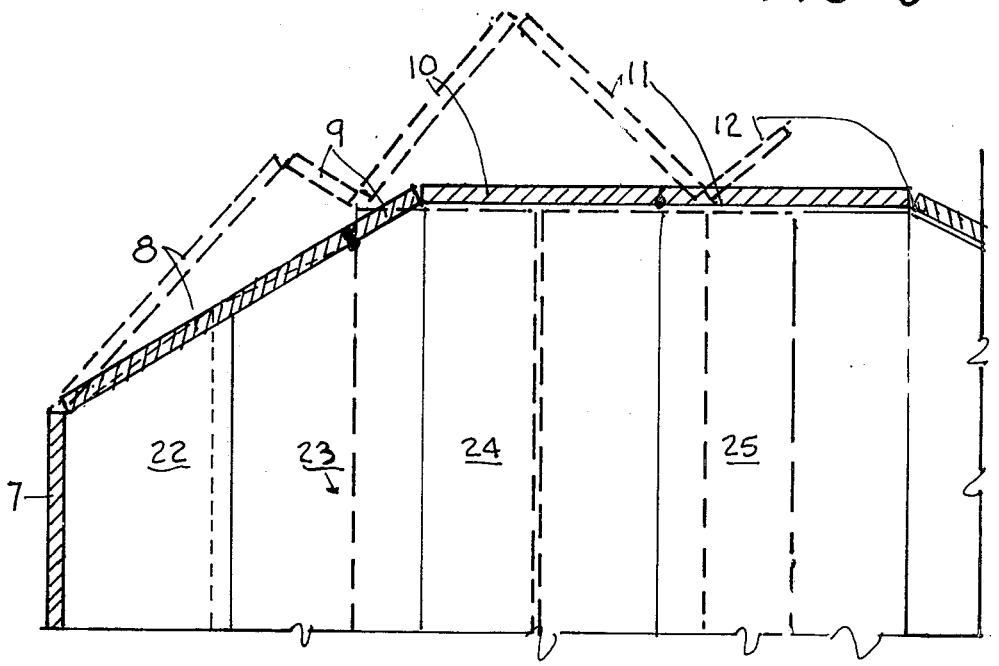
FIG. 4 Partial end plan section of FIG. 2 with floor panels.

FIG. 3 and FIG. 4 show in cross section a building as disclosed in FIG. 1. The dotted lines show panels in partially unfolded position. Floor panels 22, 23, 24, 25 and 26 are attached to side walls and lower hinge pins of end wall panels in a manner similar to the pivot connection between upper end wall panel hinges and roof plates, except that the floor panels are fully unfolded simultaneously with end wall panels reaching their distended position.

The different widths end wall panels 8 and 9 are necessary to permit the panels to unfold from the assembled position to the angular inclination of wall panel 8–9 in relation to valley line between plates 2 and 3 when unfolded.

It is noted that the end wall panels 8, 9, 10 and 12 may be unfolded to any predesigned angle relative to the valley lines, but pairs of panels must form a straight plane between adjacent points 14 to 16 and 16 to 19, to secure the roof in the folded plate configuration.

The advantage of this novel method of construction is the capability to generate long clear span relocatable buildings with all structure assembly connections completed in the folded position.

A further advantage is the great flexibility of the method to provide the means for the designer to develop a great variety of designs.

I claim:

1. A building structure comprising a folding plate roof having:

a. at least four generally trapazoidal plates, each plate being hingedly connected to the plates adjacent thereto in zig-zag fashion to provide alternate ridges and valleys at the hinges, and to permit the roof to be expanded and collapsed; and b. two side walls each having upper and lower edges and lateral ends, said side walls being hingedly connected to a lower edge of one of the outer plates of said roof; and c. two end walls, each of which is hingedly connected to and between the ends of said side walls, said end walls having an even number of panels equal in number to said trapazoidal plates; each of said wall panels being hingedly connected to the wall panel adjacent thereto; and top ends of alternate hinged joints of said end walls having a pivotal point of connection to a valley joint of said folding roof, said pivotal connection being of the type which allows pivotal movement in both vertical and horizontal directions, whereby, said roof plates and side walls, and said end wall panels are movable from a collapsed to expanded condition and vice versa.

2. A building structure according to claim 1 wherein lengths of at least two adjacent valleys are different, and the two end panels pivotally connected to and between said adjacent valleys, differ in width by an amount equal to the difference in length of said adjacent valleys.

3. A building structure according to claim 1 comprising in addition: d. a folding plate floor having at least four generally trapazoidal floor plates, each floor plate being hingedly connected to the floor plate adjacent thereto in a zig-zag fashion to provide alternate ridges and valleys at the hinges, and to permit the floor to be expanded to a flat plane and to be collapsed; and outer edge of each of the outer floor plates hingedly connected to a lower edge of one of said side walls; and lengths of alternate hinged joints between said floor panels equal in length to length of corresponding valley of said roof as measured between said pivotal connections.

* * * * *